US006866185B2

(12) United States Patent
Harrelson

(10) Patent No.: US 6,866,185 B2
(45) Date of Patent: Mar. 15, 2005

(54) DISPENSER CARTON WITH TILT PLATFORM

(75) Inventor: Glenn Harrelson, Gainesville, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 10/262,139

(22) Filed: Oct. 1, 2002

(65) Prior Publication Data

US 2004/0060972 A1 Apr. 1, 2004

(51) Int. Cl.[7] ..... B65D 5/00

(52) U.S. Cl. ..... 229/104; 229/182.1; 229/221; 221/285; 221/288; 221/305; 206/762; 206/45.26

(58) Field of Search ..... 229/182.1, 221, 229/104; 206/427, 762, 45.24, 45.25, 45.26; 221/285, 288, 302, 305

(56) References Cited

U.S. PATENT DOCUMENTS 1,416,465 A 5/1922 Harvey
1,434,165 A * 10/1922 Ten Eyck ..... 206/45.26
1,732,226 A 10/1929 Darragh
1,889,625 A 11/1932 Barter
1,909,472 A 5/1933 Keppler
2,052,675 A 9/1936 Tanner
2,294,965 A 9/1942 Davidson
2,312,595 A 3/1943 Smith
3,178,242 A * 4/1965 Ellis et al. ..... 229/122.1
4,331,231 A 5/1982 Boyle
4,433,778 A 2/1984 Maio et al.
5,878,947 A * 3/1999 Hoy et al. ..... 229/122.1
6,578,736 B2 * 6/2003 Spivey ..... 229/221
2002/0088820 A1 7/2002 Spivey

* cited by examiner

*Primary Examiner*—Tri M. Mai
(74) *Attorney, Agent, or Firm*—Womble Carlyle Sandridge & Rice, PLLC

(57) ABSTRACT

A carton with a dispenser at one end of the carton which has a tilt platform that is formed in the bottom panel of the carton at the opposite end of the carton to facilitate the rolling of containers contained in the carton toward the dispenser when the dispenser is opened. The tilt platform is an integral part of the bottom panel of the carton and can be torn partially loose and folded to form a tilt platform with a bottom wall, two side walls, two end walls and a locking flap that is inserted into a locking slot on the end of carton away from the dispenser.

3 Claims, 5 Drawing Sheets

DISPENSER CARTON WITH TILT PLATFORM

BACKGROUND OF THE INVENTION

1. Field of the Invention

The present invention relates generally to an enclosed paperboard carton capable of enclosing containers, which carton has a dispenser in one end of the carton for dispensing containers, for example, cans or bottles, which can be removed or dispensed without destroying the overall structural integrity of the carton. In order to ensure that the containers roll out of the carton through the end dispenser, a tilt platform is provided at the opposite end of the carton, so that the containers will tend to roll towards the end of the carton with the dispenser.

2. Background

Fully enclosed cartons capable of enclosing cans have been used in the past that have a dispenser in one end for dispensing the cans one at a time. All of these cartons with a dispenser in one end suffer from the limitation that when the carton lies flat in the refrigerator, pantry or on a table, the bottom row of cans has no force to move them toward the dispenser end of the carton. In order to remove cans from the bottom of the carton near the end of the carton away from the dispenser, it is frequently necessary to tilt the carton downward towards the dispensing end to allow the cans to roll towards the dispenser.

3. Prior Art

U.S. Pat. No. 3,265,283 to Farquhar discloses a fully enclosed carton having a dispenser for dispensing the enclosed cans. The end wall of the carton has a dispensing flap which can be folded down upon opening. An aperture formed by the flap extends into the side walls to permit grasping of the cans to withdraw it from the carton. When the flap is opened, the cans are held in the carton by an arcuate flap portion extending downwardly in the end wall into the center of the aperture.

U.S. Pat. No. 4,364,509 to Holly, Jr. et al. also discloses a fully enclosed carton with a dispenser in one of the end walls. This dispenser is likewise formed in the end wall by tearing out an end flap and lowering it into proper position. Expansion slits are provided in the side wall for the user's fingers to grasp the ends of the exiting can.

SUMMARY OF THE INVENTION

It is an object of this invention to provide a structure built into the carton that will force the cans to roll towards the dispenser in one end of the carton. Is a further object to provide a structure that can be built into the carton without the necessity of using any material, in addition to the paperboard that is used to construct the carton. It is another object of this invention to provide a structure that will force the containers to roll toward the dispensing end of the carton, for any type of dispenser in the end of the carton. It is a still further object of this invention to develop a structure for tilting the carton toward the dispensing end where the dispenser is constructed in such a way that containers will not automatically roll out of the end of the dispenser.

The carton of this invention is generally rectangular and has a bottom, a top, two sides, a closed end and an exiting end. The carton is foldably constructed from a blank having panels and flaps. The exiting end of the carton permits containers to be taken from the carton via the dispenser in the exiting end.

In order to facilitate containers being forced towards the dispenser in the exiting end of the carton a tilt platform is provided in the bottom panel near the other end of the carton. The tilt platform is an integral part of the bottom panel which can be partially torn from and folded by the consumer to construct the tilt platform. The tilt platform basically has a locking flap nearest the dispensing end of the carton which can be pulled loose from the bottom panel and rotated 180° and inserted into a slot between the bottom end flap and the bottom panel of the carton. The tilt platform has a bottom wall near it center which rests on the surface on which the carton is placed and elevates the non-exiting end of the carton a short distance (e.g. 1 inch) above the surface. The tilt platform has side walls and quarter panels connected to the bottom wall and two end walls by an arcuate fold line. The consumer can simply pull the locking flap of the tilt platform free, rotate it 180° and squeeze the side walls towards each other which will also move the quarter panels inwardly to form the tilt platform and insert the locking flap into the slot between the bottom end flap and bottom panel. Fold lines between the end walls and bottom wall facilitate construction of the tilt platform so that the bottom wall is parallel to the bottom panel of the carton and thus will lie flat on the surface on which the carton is placed.

The tilt platform of this invention can be used with any carton with an end dispenser. It is especially useful for the dispenser described in detail in this specification. This dispenser is torn from an end of the carton by tearing an end portion of the top panel, a triangular portion from the adjoining side panels, and all of the side end flaps except the bottom most portions, to form a dispenser. The top end flap is removed when this dispenser is opened. This dispenser may have a semi-circular score line attached to the dispenser score line in the top panel for easy opening of the dispenser. A person's fingers can be inserted between this semi-circular score line and the dispenser to commence the opening of the dispenser. This semi-circular score line is placed so that when it is pushed open, a person's fingers will go between the first and second containers inside of the carton. A score line can be provided that bisects the semi-circular score line parallel to the longitudinal axis of the containers to permit ease of entry of a person's fingers. The bottom portions of the side end flaps are left intact to preserve the structural integrity of the carton and also to provide a wall to prevent an end container in the bottom of the carton from accidentally rolling out.

It should be realized that the dispenser does not have to be totally removed from the carton, as the score lines in the side and top panels can be broken and the dispenser flipped over along the score lines in the side end flaps to form a safety net or basket when the first container in the top of the carton rolls out of the dispenser. If the score line in the side end flaps in not broken, the dispenser can be reclosed.

This carton can be constructed by gluing, taping, stapling and the like, or by locking. The dispenser of this invention can be put in one end of the carton. These and other objects, features, and advantages of the present invention will become more apparent upon reading the following specification in conjunction with the accompanying drawing figures.

DETAILED DESCRIPTION OF THE PREFERRED EMBODIMENT

Figure 1:
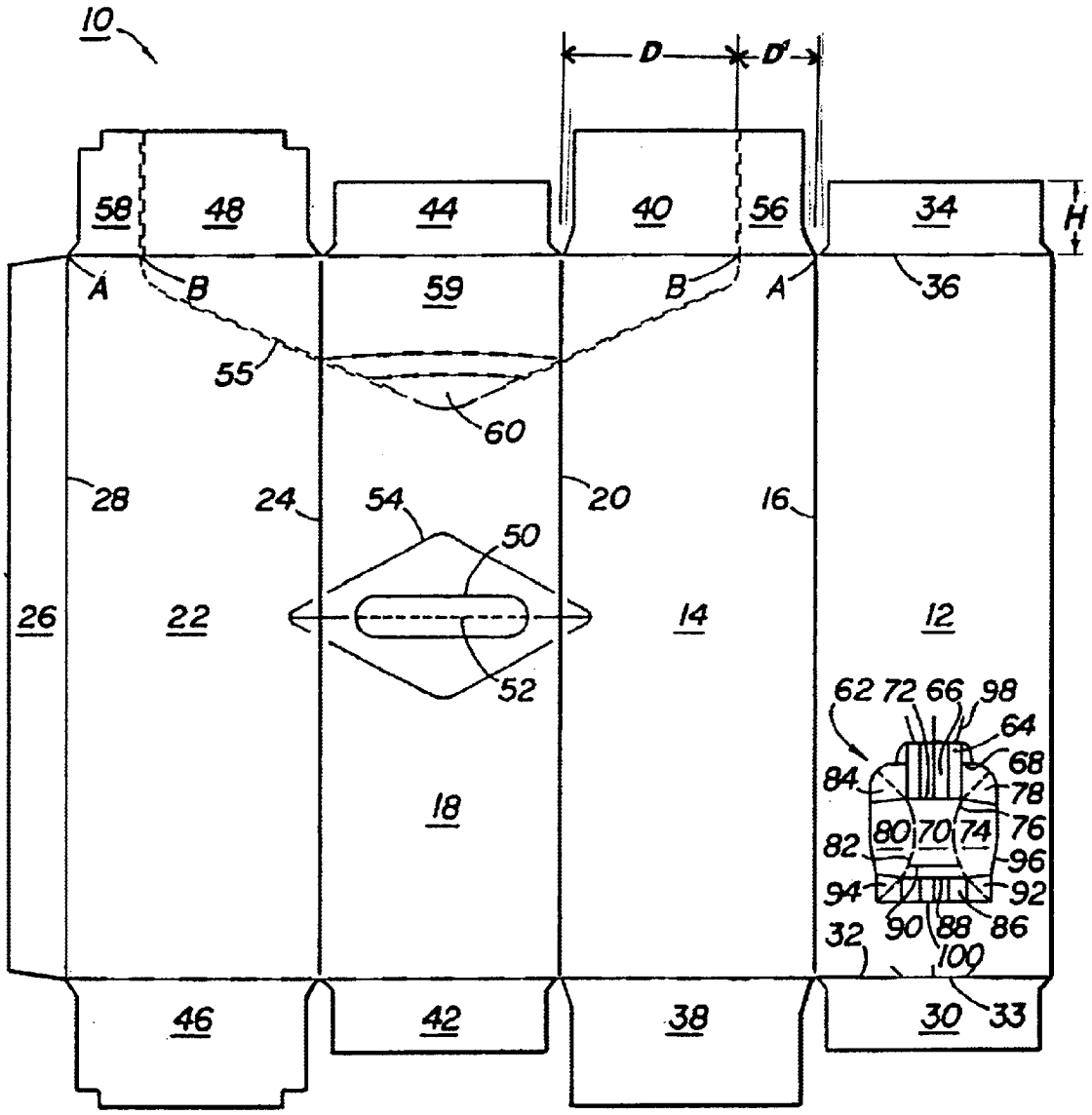
FIG. 1 is a plan view of a blank from which a carton according to this invention is formed.

The present invention is intended primarily for use with cans and bottles of the types used to contain soft drinks, beer and the like. The blank 10 is formed from a foldable sheet material, such as paperboard. The blank 10 has a bottom panel 12 which is connected to side panel 14 by fold line 16 and in turn connected to top panel 18 by fold line 20. Top panel 18 is connected to side panel 22 by fold line 24 which in turn is connected to bottom flap 26 by fold line 28. Bottom panel 12 is connected to bottom end flap 30 by fold line 32. A locking slot 33 is provided along fold line 32 whose function will be described below. Bottom panel 12 is connected to bottom end flap 34 by fold line 36. Side panel 14 is connected to side end flap 38 by fold line 32 and connected to side end flap 40 by fold line 34. Top panel 18 is connected to top end flap 42 by fold line 32 and in turn connected top end flap 44 by fold line 34. Side end flap 46 is connected to side panel 22 by fold line 32 and in turn connected to side end flap 48 by fold line 34.

This carton is capable of containing cans or bottles in two rows of six containers each. This carton has a "slotted" handle 50 which has a tear line 52 down the center of the handle which extends across the top panel 18 and may extend into side panels 14 and 22. The triangular shaped score line can assist in removing some of the stress generated in lifting the carton by the handle. Other types of handles such as the "racetrack" handle may be used. Both the racetrack and slotted handle are well know in the art.

It will be understood by those skilled in the art that the carton of the present invention is generally symmetrical about a horizontal line of bisection, as viewed in FIG. 1. This symmetry aids in the efficient production of the present carton.

In forming this blank 10 into a carton, bottom flap 26 is glued to bottom panel 12 forming a sleeve. The cans or bottles are then loaded into the cartons on their sides and the various end flaps on both ends are closed. Using one end as an example, top end flap 42 is folded downwardly and bottom end flap 30 is folded upwardly and then side end flaps 38 and 46 are folded sideways. These various end flaps are held together by glue or other means. The other end of the carton is glued and closed in the same fashion.

When the blank is folded and glued, the resulting carton has a closed end and an exiting end. The containers exit the carton through the exiting end of the carton. The exiting end of the carton has a tear line 55 that extends through top panel 18 and side panels 14 and 22 and into side end flaps 40 and 48 to form the triangular dispensing flap 59. In order to facilitate the opening of this dispensing flap 59, a finger flap 60 may be provided for the easy insertion of the fingers to start the tearing of the dispenser flap 59. It will be noticed that tear line 55 extends into side ends flaps 40 and 48 so as to form a substantial bottom portion 56 and 58 so that the end of the carton will have a bottom end when dispensing flap 59 is opened to create the dispenser.

Figure 2:
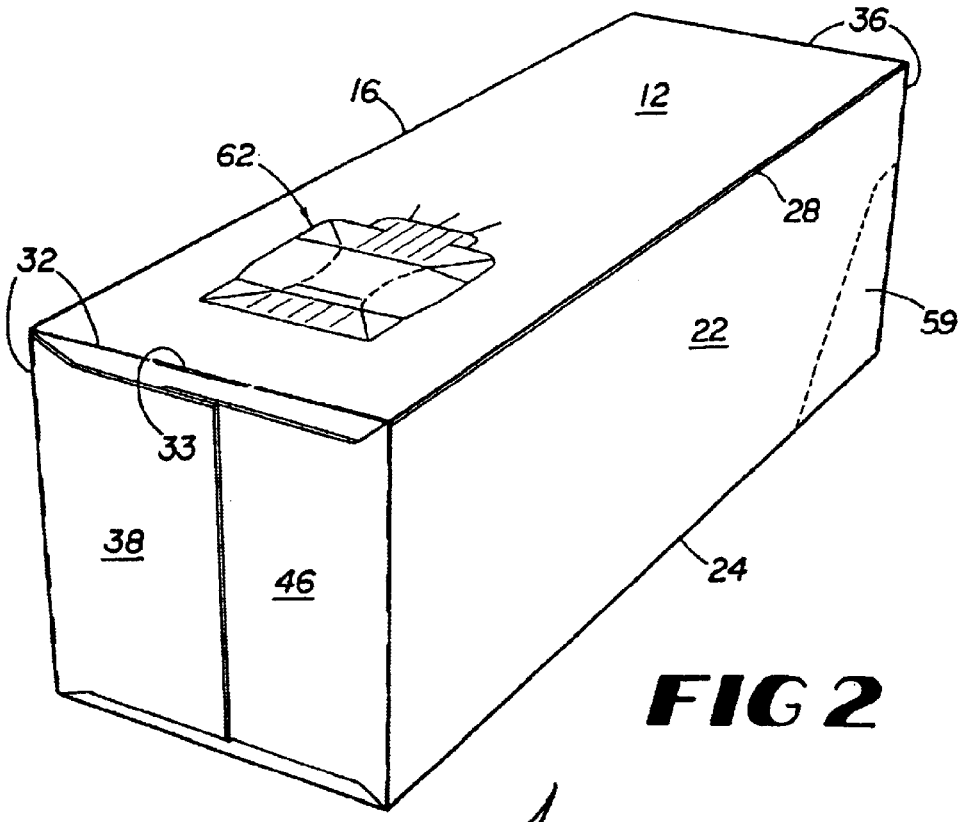
FIG. 2 is a perspective end view of the carton loaded with cans with the bottom panel of the carton facing upwardly and disclosing the score and tear lines in the bottom panel for forming the tilt platform.

This carton has a unique tilt platform 62 as illustrated in FIG. 2, which is formed in bottom panel 12 of the carton. Tilt platform 62 is attached to the bottom panel 12 by tear line 96 and fold line 100. The tilt platform 62 has a locking flap 64 which is attached to end wall 66 by fold line 68 and in turn attached to bottom wall 70 by fold line 72. Bottom wall 70 is attached to side wall 74 by arcuate fold line 76 which also forms quarter panel 78. Bottom wall 70 is attached to side wall 80 by arcuate fold line 82 which also forms quarter panel 84. Bottom wall 70 is attached to end wall 86 by fold line 90. End wall 86 may have an additional fold line 88 to facilitate the construction of the tilt platform 62. Arcuate fold lines 76 and 82 also form quarter panels 92 and 94 respectively. Slits 98 may be provided to facilitate opening the tilt platform. End wall 86 is foldably attached to bottom panel 12 of the carton by fold line 100.

Figure 3:
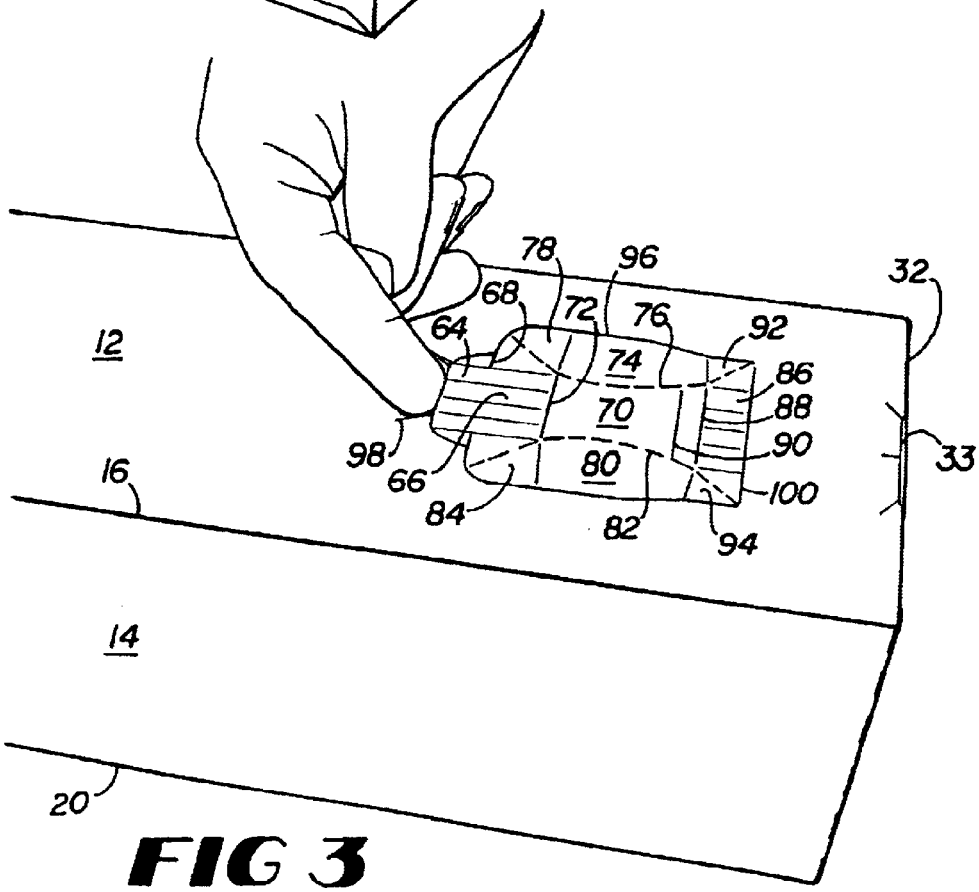
FIG. 3 is a perspective side view of the carton showing a person commencing to pull the locking flap to form the tilt platform.
Figure 4:
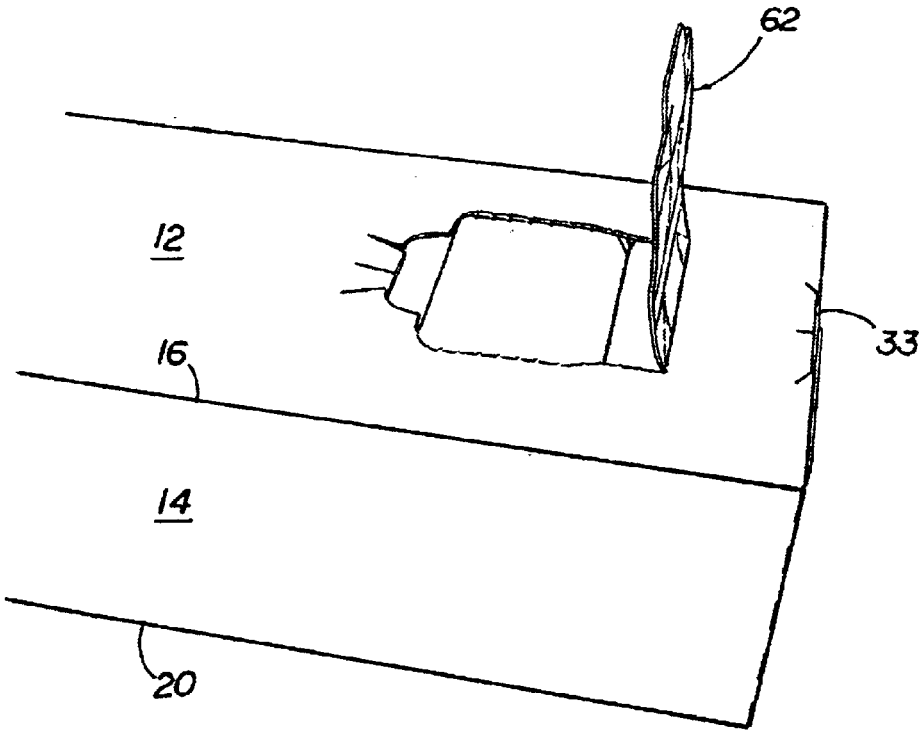
FIG. 4 is a perspective side view showing the entire tilt platform, except for an end fold line, being torn from the bottom panel of the carton.
Figure 5:
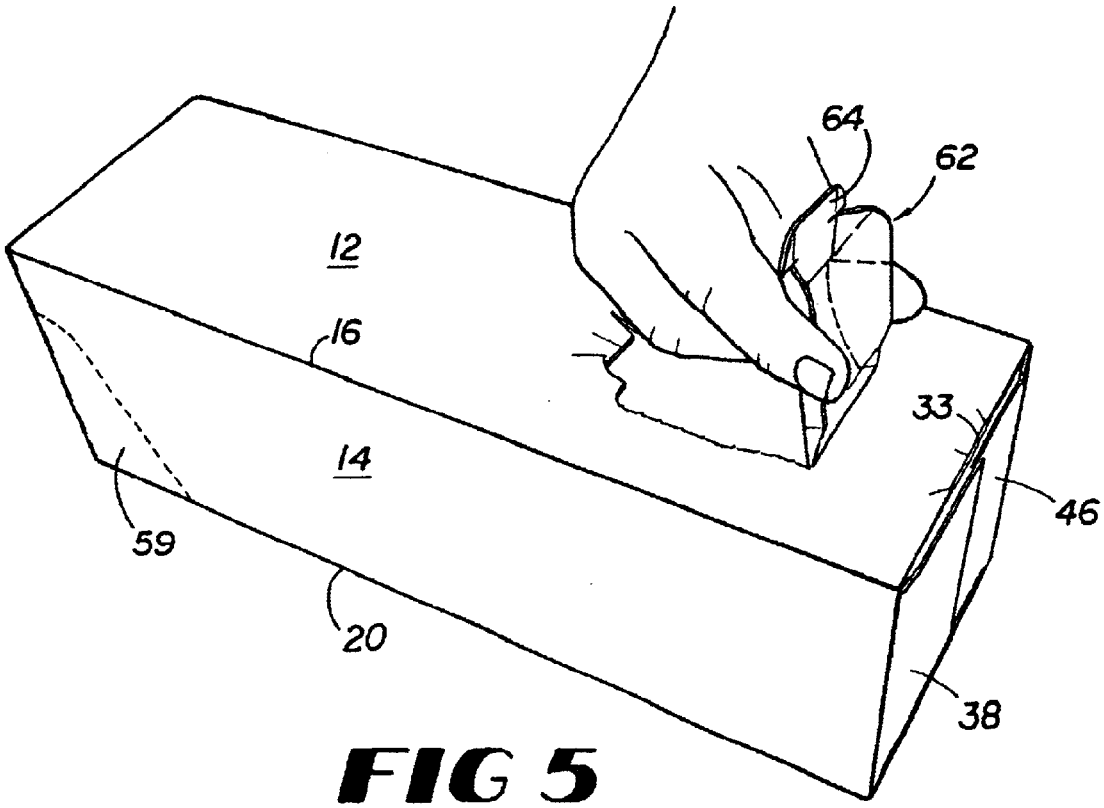
FIG. 5 is a perspective view of the side of the carton showing the tilt platform side walls being squeezed inwardly to form the tilt platform.
Figure 6:
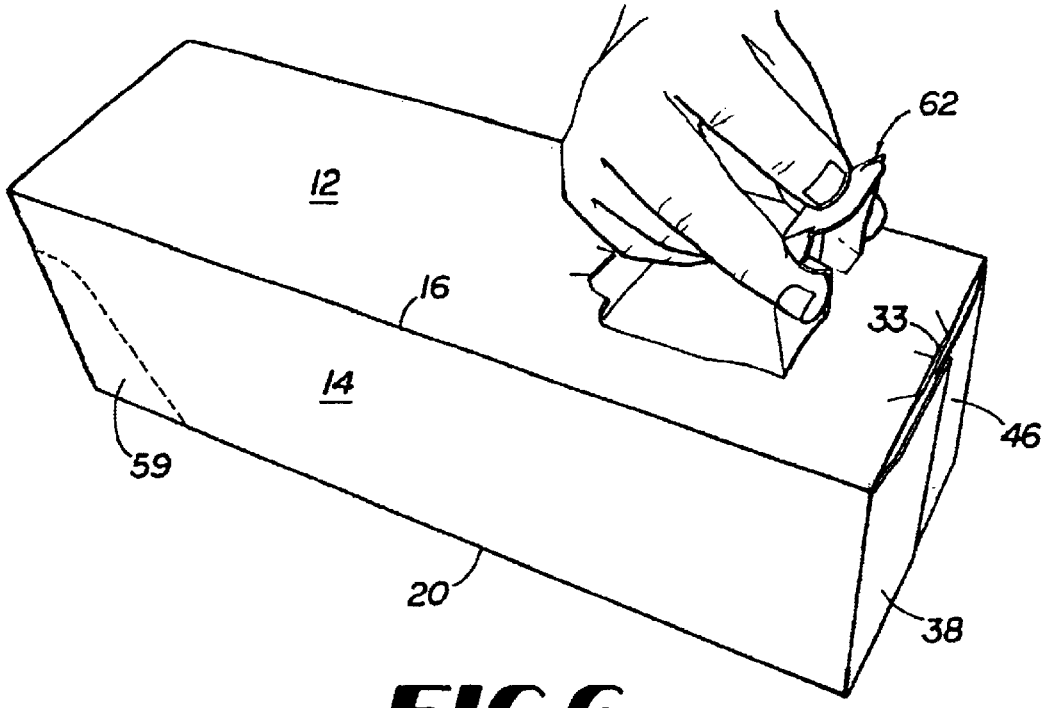
FIG. 6 shows folding the locking flap of the tilt platform in a downward position.
Figure 7:
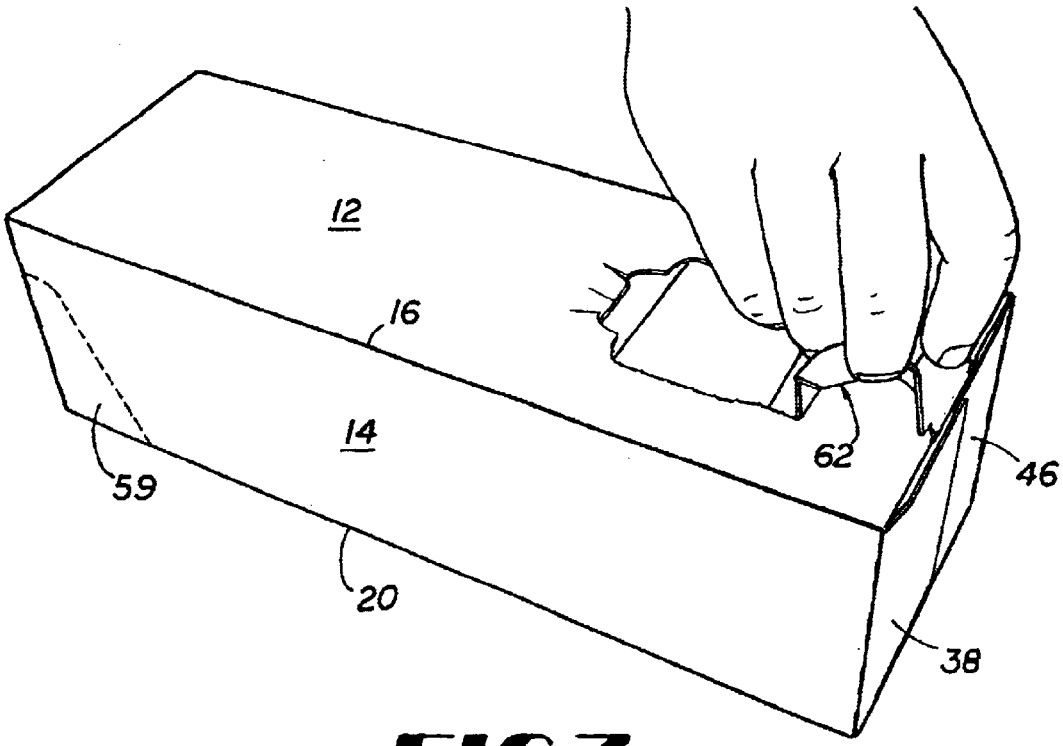
FIG. 7 shows a final step of inserting the locking flap in a slot inside of the bottom end flap.
Figure 8:
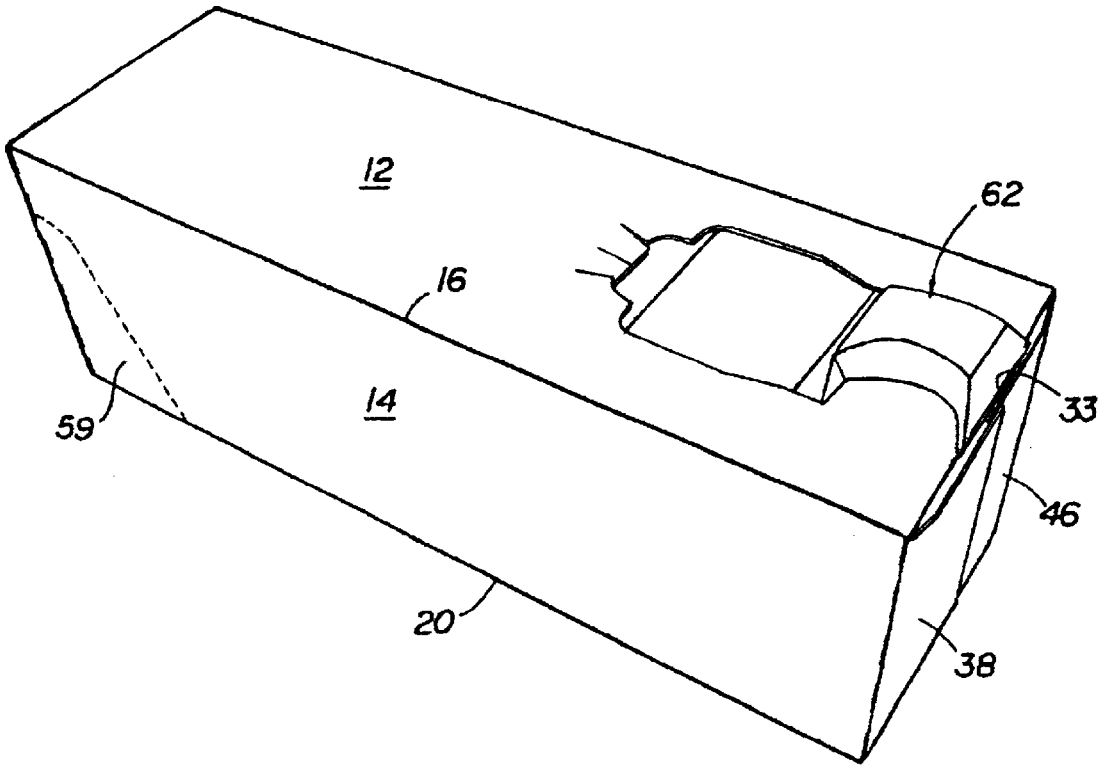
FIG. 8 is a perspective view of the side of a carton showing the tilt platform fully constructed.
Figure 9:
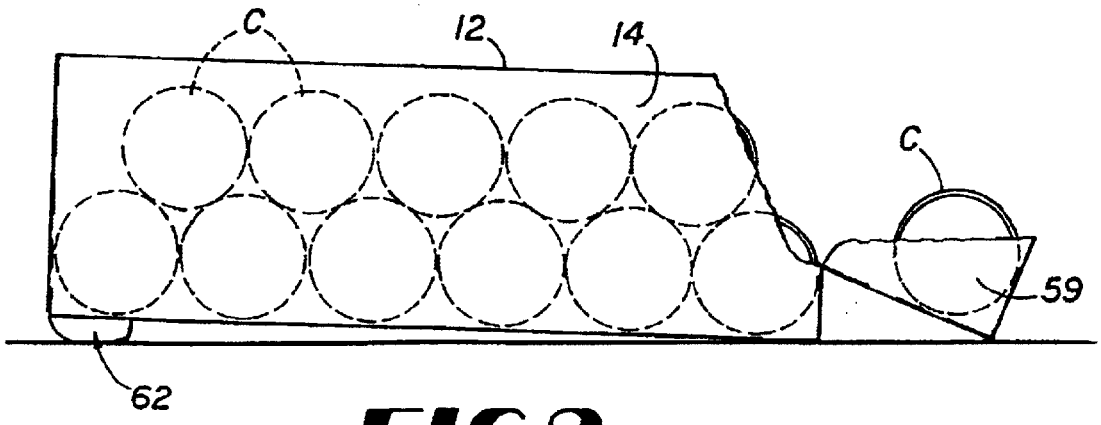
FIG. 9 is a perspective side view of the carton with the dispenser open and the end of the carton away from the dispenser resting on the tilt platform.

The consumer can easily construct the tilt platform before placing the carton on a shelf in a pantry or refrigerator. The consumer will open the tilt platform by pulling locking flap 64 as illustrated in FIG. 3. Slits 98 facilitate the insertion of the finger under locking flap 64. The locking flap 64 is pulled upwardly resulting in the tearing of tear line 96 through to fold line 100 as illustrated in FIG. 4. The consumer then squeezes side wall 74 and 80 inwardly which results in quarter panels 78, 84, 94 also being squeezed inwardly as shown in FIG. 5. The construction of this tilt platform 62 is facilitated by the fact that fold lines 76 and 82 are arcuate in form. Locking flap 64 is then pushed downwardly as illustrated in FIG. 6. Locking tab 64 is then bent downwardly toward the bottom panel 12 and inserted in locking slot 33 to finish the construction of the tilt platform 62 as illustrated in FIG. 7. The finished tilt platform 62 is illustrated in FIG. 8, with top panel of the carton resting on a table or other flat surface. The tilt panel 62 results in the end of the carton away from the dispenser being slightly elevated from the surface (e.g. approximately one inch) as illustrated in FIG. 9. The dispenser can then be opened as illustrated in FIG. 9 and the cans removed. This slight tilt of the carton will allow all of the cans to roll forward to the dispensing end of the carton. As illustrated by the simple instructions above, the tilt platform 62 is easy for the consumer to make and is especially useful on refrigerator shelves to ensure that all of the cans roll forward to be removed through the dispenser. The dispensing flap 59 can be removed if desired.

As illustrated in FIG. 9, the dispensing flap 59 can be left attached to the carton by tear line 55 not being torn through side ends flaps 40 and 48. The dispensing flap 59 in effect forms a basket so that the first top can C will fall into the basket formed by the dispensing flap 59 and be retained when the dispenser is opened. This dispensing flap 59 serves as a safety net to prevent the can from leaving the vicinity of the carton. If desired the dispensing flap 59 can be totally removed from the carton, or left attached along tear line 55 in side ends flaps 40 and 48.

In order to maintain the structural integrity of the carton, the bottom portions 56 and 58 of side end flaps 40 and 48 are not removed from the carton when the dispenser is removed. The structural integrity of the carton is improved by the fact that the bottom end flap 44 is not removed. The bottom end flap 34 has a height H approximately equal to the distance between A and B along fold line 36 on bottom portion 56 and A and B on bottom portion 58. This means that the bottom end flap 34 has the same height as the bottom portions 56 and 58 of side end flaps 40 and 48. The distance D between the tear line 56 where it crosses fold line 36 and the too panel 18 is greater than the distance D' between tear line 55, where it crosses fold line 36, and the bottom panel 12.

The tilt platform of this invention can be used with any carton that has a end dispenser where it is necessary for the containers, such as cans, to roll forward towards the dispensing end for removal. While the tilt platform described above is utilized on a carton in a 2×6 configuration, it can also be used in 3×4 configuration where the dispenser is in an end wall.

Unique Features of the Tilt Platform of this Invention

One of the unique features of the tilt platform of this invention is that it is an integeral part of and constructed from a portion of the bottom panel of the carton and does not require the use of any additional material than is contained in the regular carton. This tilt platform can be easily torn partially loose from the bottom panel and formed into the tilt platform by making a few folds and inserting the locking flap into the locking slot. The use of this tilt platform near the end of the carton away from the dispenser ensures that all of the containers in the carton roll forward toward the dispenser for easy removal.

While the invention has been disclosed in its preferred forms, it will be apparent to those skilled in the art that many modifications, additions, and deletions can be made therein without departing from the spirit and scope of the invention and its equivalents as set forth in the following claims.

Therefore, having thus described the invention, at least the following is claimed:

1. An enclosed carton for carrying a plurality of containers, the carton having a closed end and an exiting end, the carton comprising:

a bottom panel, top panel and foldably attached adjoining side panels and end flaps for closing each end of the carton, said end of the carton opposite the exiting end having a locking slot near the bottom panel, the bottom panel having a tilt platform far elevating the end of the carton opposite the exiting end when the carton is resting on a flat surface, said tilt platform being formed out of said bottom panel and having a bottom wall designed to rest on the surface on which the carton is placed, the bottom wall being foldably connected to two side walls for supporting the tilt platform, said bottom wall being foldably connected to two end walls with the end wall closest to the end opposite the exiting end being foldably connected to the bottom panel of the carton) the other end wall being foldably connected to a locking flap which is secured into said locking slot to hold the tilt platform in an elevated position in relation to the bottom panel of the carton, wherein the bottom wall of the tilt platform has a center, said bottom wall being foldably attached to the two side walls by arcuate fold lines, each of which extends into each end wall to form a quarter panel adjacent each end wall and said wall to facilitate folding the tilt platform into its proper form, said arcuate fold lines being closest to each other near the center of the bottom wall.

2. An enclosed carton for carrying a plurality of containers in two rows, a top and bottom row, the carton having a closed end and an exiting end, the carton comprising:

a bottom panel, top panel and foldably attached adjoining side panels and end flaps for closing each end of the carton, said end of the carton opposite the exiting end having a locking slot near the bottom panel, said exiting end of the carton having a side end flap attached to each side panel and a bottom cod flap attached to the bottom panel, said dispenser being formed by a tear line extending through the top panel at a distance spaced from the exiting end and extending at an angle through each side panel towards the exiting end to the attachment of said side panel with a side end flap at a distance greater from the top panel than the bottom panel, said tear line extending through each side end flap at a distance from the bottom panel approximately equal to the height of the bottom end flap so that an opening for dispensing containers is formed when the tear line is torn, said bottom end flap and bottom portion of each said end flap remaining attached to the carton to provide structural integrity to the carton, the bottom panel having a tilt platform for elevating the end of the carton opposite the exiting end when the carton is resting on a flat surface, said tilt platform being formed out of said bottom panel and having a bottom wall designed to test on the surface on which the carton is placed, the bottom wall being foldably connected to two side walls for supporting the tilt platform, said bottom wall being foldably connected to two end walls with the end wall closest to the end opposite the exiting end being foldably connected to the bottom panel of the carton, the other end wall being foldably connected to a locking flap which is secured into said locking slot to hold the tilt platform in an elevated position in relation to the bottom panel of the carton, wherein the bottom wall of the tilt platform has a center, said bottom wall being foldably attached to the two side walls by arcuate fold lines, each of which extends into each end wall to form a quarter panel adjacent each end wall and side wall to facilitate folding the tilt platform into its proper form, said arcuate fold lines being closest to each other near the center of the bottom wall.

3. A tilt platform for a carton to hold one end of the carton in an elevated position on a flat surface, said carton having two ends, a bottom panel, top panel and foldably attached adjoining side panels, and end flaps for closing each end of the carton, with one end having a locking slot, said tilt platform being formed out of said bottom panel and having a bottom wall designed to rest on the surface on which the carton is placed, the bottom wall of the tilt platform having a center, said bottom wall being foldably attached to the two side walls by arcuate fold lines that extend into each end wall to form a quarter panel adjacent to each end wall and side wall to facilitate folding the tilt platform into its proper form, said arcuate fold lines being closest to each other near the center of the bottom wall, the bottom wall being foldably connected to two side walls for supporting the tilt platform, said bottom wall being foldably connected to two end walls with the end wail closest to the locking slot being foldably connected to the bottom panel of the carton, the other end wall being foldably connected to a locking flap which is secured in said locking slot to hold the tilt platform in an elevated position in relation to the bottom panel of the carton.

* * * * *

UNITED STATES PATENT AND TRADEMARK OFFICE

CERTIFICATE OF CORRECTION

PATENT NO. : 6,866,185 B2
DATED : March 15, 2005
INVENTOR(S) : Glenn Harrelson

It is certified that error appears in the above-identified patent and that said Letters Patent is hereby corrected as shown below:

Column 5,
Line 47, delete "far" and insert -- for --.
Line 56, delete ")" and insert -- , --.

Column 6,
Line 9, delete "cod" and insert -- end --.
Line 27, delete "test" and insert -- rest --.

Signed and Sealed this

Twenty-fourth Day of May, 2005

JON W. DUDAS
*Director of the United States Patent and Trademark Office*